US011391053B1

(12) United States Patent
Rosen

(10) Patent No.: US 11,391,053 B1
(45) Date of Patent: Jul. 19, 2022

(54) LOW-SLUNG BOOTH

(71) Applicant: Michal Rosen, Givatayim (IL)

(72) Inventor: Michal Rosen, Givatayim (IL)

( * ) Notice: Subject to any disclaimer, the term of this patent is extended or adjusted under 35 U.S.C. 154(b) by 0 days.

(21) Appl. No.: 17/243,619

(22) Filed: Apr. 29, 2021

Related U.S. Application Data

(60) Provisional application No. 63/156,365, filed on Mar. 4, 2021.

(51) Int. Cl.
*E04H 1/12* (2006.01)
*E04B 1/343* (2006.01)

(52) U.S. Cl.
CPC ..... *E04H 1/125* (2013.01); *E04B 1/34336* (2013.01)

(58) Field of Classification Search
CPC ..... E04H 1/125; E04B 1/34336
USPC ..... 52/79.1
See application file for complete search history.

(56) References Cited

U.S. PATENT DOCUMENTS 242,739 A * 6/1881 Arnold ..... E04H 15/003 135/900
2,718,672 A * 9/1955 Patterson ..... A47B 46/00 312/307
2,962,132 A * 11/1960 Reinhardt ..... E04B 2/7422 52/27
3,588,209 A * 6/1971 Nathan ..... A47F 9/00 312/140.2
4,223,967 A * 9/1980 Royer ..... E04H 1/12 312/245
4,360,991 A * 11/1982 West ..... E04B 2/7416 49/70
4,478,467 A * 10/1984 Tyndall ..... A47B 43/00 211/87.01
4,630,627 A * 12/1986 Windows ..... E04H 15/48 135/912
5,172,530 A * 12/1992 Fishel ..... A47B 21/06 160/135
5,862,827 A * 1/1999 Howze ..... E04H 15/001 135/900
6,053,588 A * 4/2000 Biggel ..... A47B 21/00 312/249.11
6,467,221 B1 * 10/2002 Bigelow ..... B64D 11/00 244/171.9
6,851,734 B2 * 2/2005 Findley ..... B60G 3/00 296/171

(Continued)

FOREIGN PATENT DOCUMENTS

FR 2626305 A1 * 7/1989 ..... E04H 11/1222
WO WO-9207152 A1 * 4/1992 ..... E04H 3/02

(Continued)

*Primary Examiner* — Brian D Mattei
*Assistant Examiner* — Joseph J. Sadlon
(74) *Attorney, Agent, or Firm* — JMB Davis Ben-David

(57) ABSTRACT

A low-slung movable personal booth includes two opposing sidewalls and a rear wall. The opposing sidewalls are rigidly connected to the rear wall thereby to form a cubicle structure having a usable space therein. A structural continuity member extends between and connects the sidewalls so as to provide structural continuity within the cubicle structure. A low friction mobility apparatus is mounted along the lower edge portions of both sidewalls and of the rear wall, for supporting the cubicle structure on a support surface and so as to facilitate movement of cubicle structure along the support surface in response to a lateral force.

9 Claims, 20 Drawing Sheets

(56) References Cited

U.S. PATENT DOCUMENTS

| | | | | |
|---|---|---|---|---|
| 7,975,325 | B2 * | 7/2011 | Holmstadt | E04H 1/1216 4/449 |
| 8,002,141 | B2 * | 8/2011 | Duffield | E04H 1/12 220/677 |
| 9,416,527 | B2 * | 8/2016 | McInerney | A01M 31/025 |
| 9,534,407 | B2 * | 1/2017 | Ballantyne | E04H 1/1277 |
| 10,039,681 | B2 * | 8/2018 | Ballantyne | E04B 1/34384 |
| 10,099,512 | B2 * | 10/2018 | Hsieh | B60B 33/0063 |
| 10,907,370 | B1 * | 2/2021 | Waskey | E04B 1/8218 |
| D922,613 | S * | 6/2021 | Pucci | E04H 1/125 D25/16 |
| 2003/0024172 | A1 * | 2/2003 | Lyons | E04H 1/125 52/79.1 |
| 2004/0035060 | A1 * | 2/2004 | Miyazaki | A47B 53/02 52/36.5 |
| 2006/0016134 | A1 * | 1/2006 | Luchinger | G01G 21/286 52/79.1 |
| 2006/0048458 | A1 * | 3/2006 | Donald | E04H 9/14 52/69 |
| 2009/0019635 | A1 | 1/2009 | Chen | |
| 2009/0019811 | A1 * | 1/2009 | Goldman | E04B 1/3483 52/653.2 |
| 2018/0305943 | A1 | 10/2018 | Pucci | |
| 2018/0320394 | A1 | 11/2018 | Reaves | |

FOREIGN PATENT DOCUMENTS

| | | | | |
|---|---|---|---|---|
| WO | WO-2016070172 | A1 * | 5/2016 | B26D 1/02 |
| WO | WO-2020085276 | A1 * | 4/2020 | |

* cited by examiner

LOW-SLUNG BOOTH

CROSS-REFERENCE TO RELATED APPLICATIONS

This U.S. Non-Provisional patent application claims the benefit of U.S. Provisional Patent Application No. 63/156,365, filed on Mar. 4, 2021, which is incorporated herein by reference.

FIELD OF THE INVENTION

The invention relates to booths for personal use.

BACKGROUND

Personal booths are found in a multitude of different environments, from office spaces to airports to homes. These booths usually consist of three or four walls, a floor and ceiling to provide support for the walls, and a set of wheels to permit movement thereof.

Structures such as these may be found, for example, in PCT/US2017/027793 entitled "Modular Booth" and PCT/IB2020/050306 entitled "A Mobile Cabin with Ventilation System and A Method for Ventilation Thereof."

A common feature among known art, such as referenced above, is the provision of a small number of wheels for assisting with movement from one position to another. Structures such as these may be heavy, having a weight which may vary from 150-350 kg. Each wheel, and its accompanying support is liable to cause an uneven application of force to the structure, the force being concentrated at a small number of points, namely, at each of the wheel supports. The force to be borne by each of the wheel supports includes not only that arising from the self-weight of the structure but also dynamic forces when the structure is moved. It will thus be appreciated that provision has to be made to redistribute these concentrated forces throughout the structure, as well as local strengthening of the structure in the region of each of the wheel supports. This inherently limits the number of times that the structure can be moved without deleteriously affecting its structural integrity, thus shortening its useful life.

PCT/IB2020/050306 entitled "A Mobile Cabin with Ventilation System and A Method for Ventilation Thereof" describes a relatively massive structure. While such a structure potentially solves the above disadvantage by being more robust and therefore able to absorb greater forces, this also increases its self-weight making it more difficult to move.

SUMMARY

The following embodiments and aspects thereof are described and illustrated in conjunction with systems, tools and methods which are meant to be exemplary and illustrative, not limiting in scope.

In one embodiment, there is provided a low-slung movable personal booth for positioning on a support surface, which includes a first and second opposing sidewalls, each having a rear edge portion, a front edge portion, an upper edge portion, and a lower edge portion which terminates in a lower sidewall edge; a rear wall having a pair of parallel side edge portions, a lower edge portion which terminates in a lower rear wall edge, and an upper edge portion which terminates in an upper rear wall edge; the rear edge portion of each of the first and second opposing sidewalls is rigidly connected to one of the pair of parallel side edge portions of the rear wall, such that the sidewalls and rear wall form a cubicle structure having a usable space therein; one or more structural continuity members connect between the pair of opposing sidewalls so as to provide structural continuity within the cubicle structure; a low friction mobility apparatus, mounted along the lower edge portion of each of the first and second sidewalls and of the rear wall, arranged to support the cubicle structure on the support surface and to facilitate movement thereof along the support surface in response to a lateral force, wherein the mobility apparatus is configured to distribute both static and dynamic loads, respectively caused by self-weight of the cubicle structure and movement thereof along the support surface, in a generally uniform distribution along the sidewalls and the rear wall.

Additionally, in accordance with an embodiment, one or more structural continuity members includes a planar support element connecting between the lower edge portions of the cubicle structure, positioned so as to support the cubicle structure on the support surface.

Further, in accordance with an embodiment, a planar support element also includes a low friction mobility apparatus so as to assist movement of the personal booth along the support surface.

Additionally, in accordance with an embodiment, the planar support element is a floor element which includes an upward facing surface and a downward facing surface, and the low friction mobility apparatus includes a plurality of low friction mobility elements embedded into the downward facing surface of the floor element, wherein the low friction mobility elements protrude from the downward facing surface to support the floor element on the support surface.

Further, in accordance with an embodiment, the one or more structural continuity element includes a ceiling element connected between the upper edge portions of the cubicle structure.

Additionally, in accordance with an embodiment, the cubicle structure includes a front facing opening, a closure element for providing access to the interior, and a mounting element for mounting the closure element in association with the front facing opening.

Further, in accordance with an embodiment, the low friction mobility apparatus is a plurality of ball transfer units aligned linearly and mounted in association with the lower edge portion of the first and second sidewalls and the rear wall, configured to evenly distribute both static and dynamic loads.

Additionally, in accordance with an embodiment, the one or more structural continuity member includes a tie member removably fastenable to the front edge portions of the first and second opposing sidewalls, for fastening thereto prior to movement of the low-slung movable personal booth and removal therefrom after movement.

Further, in accordance with an embodiment, the low friction mobility apparatus is a planar element formed of a low friction material.

Additionally, in accordance with an embodiment, there is provided a low-slung movable personal booth for positioning on a support surface including a first and second opposing sidewalls, each having a rear edge portion, a front edge portion, an upper edge portion, and a lower edge portion which terminates in a lower sidewall edge; a rear wall having a pair of parallel side edge portions, a lower edge portion which terminates in a lower rear wall edge, and an upper edge portion which terminates in an upper rear wall edge, wherein the rear edge portion of each of the first and second opposing sidewalls is rigidly connected to one of the pair of parallel side portions, such that the sidewalls and rear wall form a cubicle structure having a usable space therein; a floor element which includes an upward facing surface and a downward facing surface connecting between the pair of opposing sidewalls in association with the lower edge portions of the cubicle structure so as to provide structural continuity within the cubicle structure the sidewalls and the rear wall; an array of low friction mobility elements embedded into the downward facing surface of the floor element, arranged to support the cubicle structure on the support surface and to facilitate movement thereof along the support surface in response to a lateral force.

Further, in accordance with an embodiment, the low friction mobility elements protrude through the upward facing surface of the floor element.

BRIEF DESCRIPTION OF THE DRAWINGS

The present invention will be more fully understood and appreciated from the detailed description, taken in conjunction with the drawings, in which.

Figure 1A:
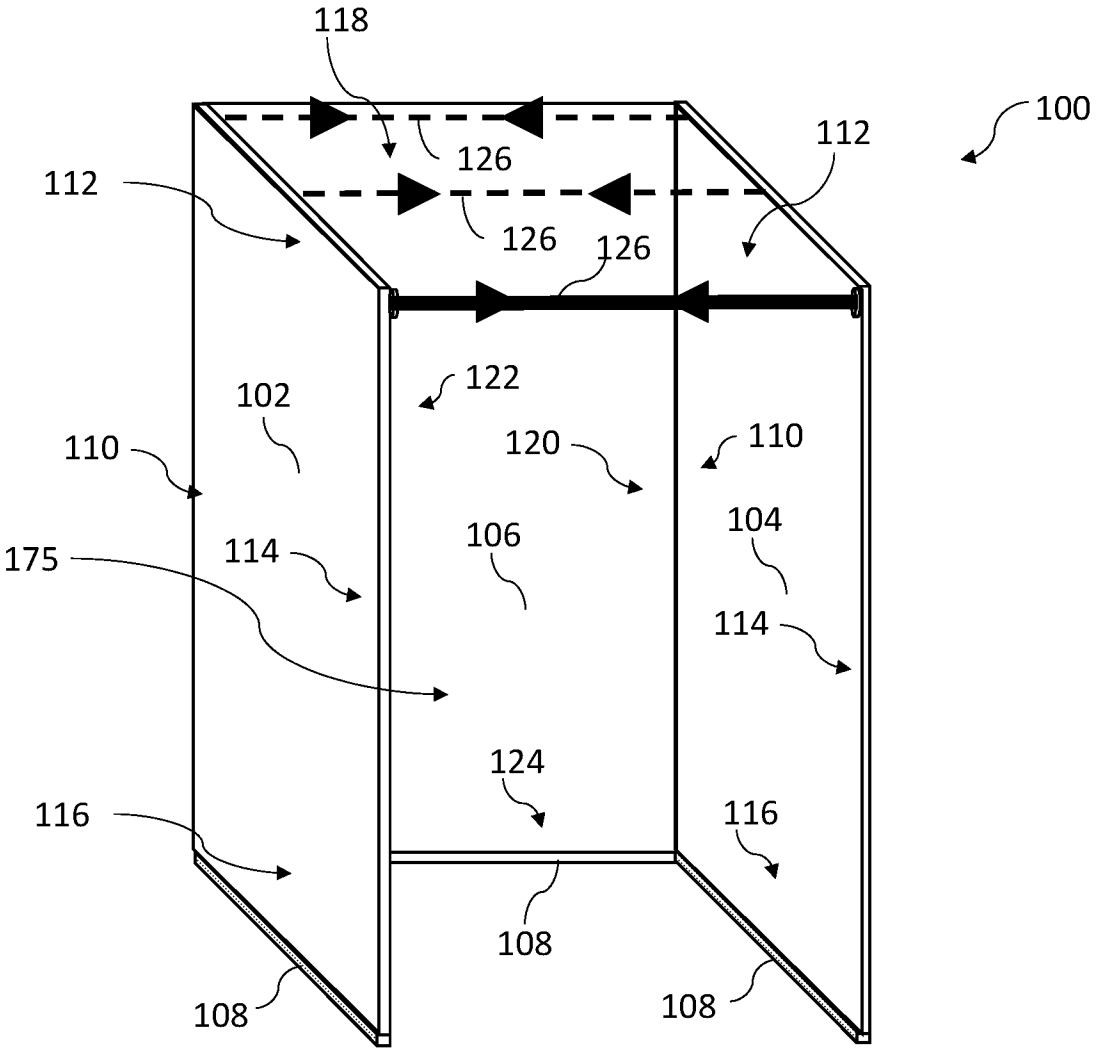
FIG. 1A is a schematic illustration of a low-slung movable personal booth, in accordance with certain exemplary embodiments.

Identical, duplicate, equivalent or similar structures, elements or parts that appear in one or more drawings are generally labelled with the same reference numeral, optionally with an additional letter or letters to distinguish between similar entities or variants of entities, and may not be otherwise repeatedly labelled and/or described. References to previously presented elements are implied without necessarily further citing the drawing or description in which they appear.

Dimensions of components and features shown in the figures are chosen for convenience or clarity of presentation and are not necessarily shown to scale or true perspective. For convenience or clarity, some elements or structures are not shown or shown only partially and/or with different perspective or from different viewpoints.

DETAILED DESCRIPTION

Disclosed herein is a low-slung movable personal booth, denoted generally in the drawings by reference numeral 100.

Referring now to FIG. 1A, booth 100 has a pair of opposing sidewalls, respectively referenced 102 and 104. Each sidewall has a rear edge portion 110, a front edge portion 114, an upper edge portion 112 and a lower edge portion 116. Disposed between rear edge portions 110 of the sidewalls 102 and 104 is a rear wall 106 which has an upper edge portion 118, a lower edge portion 124 and two parallel side edge portions 120 and 122. Rear edge portions 110 of sidewalls 102 and 104 are rigidly connected to the parallel side edge portions 120 and 122 of rear wall 106, such that booth 100 has a cubicle type structure having a usable space within that is accessible through a front-facing opening 175. Hereinbelow, the terms booth and cubicle may be used interchangeably.

In some embodiments, there may be provided one or more structural continuity member 126, connecting between opposing sidewalls 102 and 104, for providing structural continuity among the different constructional elements of cubicle 100. Structural continuity member 126, illustrated in the drawings schematically, can be a crossbeam, an L-shaped bracket, or any other structural tie or a constructional element such as a floor or ceiling member that fulfils this function, thereby generally reinforcing and providing structural integrity to booth 100.

Optionally, there may also be provided additional ties, struts, bracing members or other structural elements (not shown) which may be either external or internal to the structural members illustrated.

Mounted to respective lower edge portions 116 and 124 is elongate low friction mobility apparatus 108. Low friction mobility apparatus 108 is operative to support the cubicle structure on a support surface 350 (FIG. 3B) and to uniformly distribute both static and dynamic loads caused by the self-weight of the cubicle structure and movement thereof along support surface 350 in a generally uniform distribution along sidewalls 102 and 104 and rear wall 106. In some embodiments, low friction mobility apparatus 108 is an array of mini ball transfer units arranged along a track member, as described in greater detail in conjunction with FIG. 3B. The track member is attached to respective lower edge portions 116 and 124 of the cubicle 100. The mini ball transfer units can be the Flange Fixing Unit 0531, from Alwayse Engineering as can be found at www.alwayse-.co.uk, or any other suitable mini ball transfer unit.

In some embodiments, low friction mobility apparatus 108 is an elongate track member made from anti-static sliding material configured to be attached to respective lower edge portions 116 and 124 of the cubicle 100. This anti-static material can be constructed from LubX CV material, as can be found at www.roechling-industrial.com, or any other suitable material.

Figure 1B:
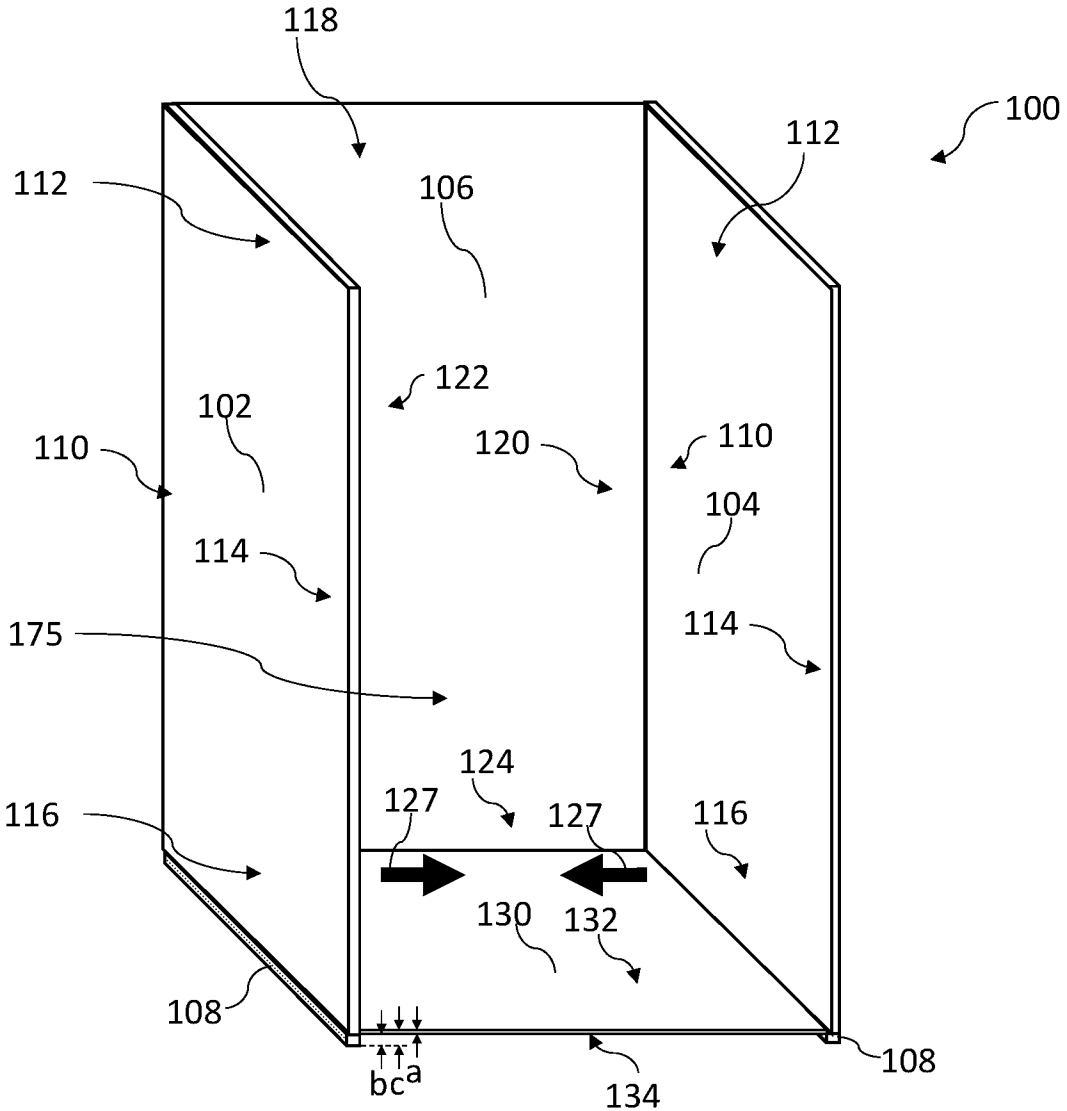
FIGS. 1B-1D are schematic illustrations of a low-slung movable personal booth with the addition of a floor and/or ceiling.

Referring now to FIG. 1B, booth 100 is seen to also include a floor member 130 which has an upward facing surface 132 and a downward facing surface 134. Floor member 130 is mounted to respective lower edge portions 116 and 124, parallel to the support surface 350. Floor member 130 is positioned such that there is a gap between downward facing surface 134 and the support surface 350. The gap formed between the downward facing surface 134 of floor member 130 and the support surface 350 has a height 'b', and the thickness of floor member 130 is shown as 'a', such that the total height from the support surface to upward facing surface 132 of floor member 130 is 'c'. Preferably, dimension c is no higher than the maximum height for a single step up into a new room according to safety regulations and building codes. In some countries, for example, Israel, this height is 1.5 centimeters (cm). In some embodiments, floor member 130 provides structural continuity as denoted by the pair of arrows 127, for cubicle 100.

This provides the present booth 100 with a significant advantage when compared with known wheel-mounted structures. Such structures to be both movable and to provide privacy. As movability is provided by the provision of a small number of relatively large wheels, the floor of the booth—required so as to provide privacy—is elevated, normally some 10-20 cm above the surface on which the booth stands. The provision of a suspended floor requires an appropriate support structure, constituting an additional weight and cost component. Furthermore, the elevated floor at the height required by the provision of the wheels, as described, requires a user to step up into the booth in order to enter. It has been found, however, that having a single step up into a room does not easily register to the human eye and can thus be a tripping hazard. All of the above issues are solved by the provision of low friction mobility apparatus 108, facilitating full support of booth 100 at negligible elevation, as described.

Figure 1C:
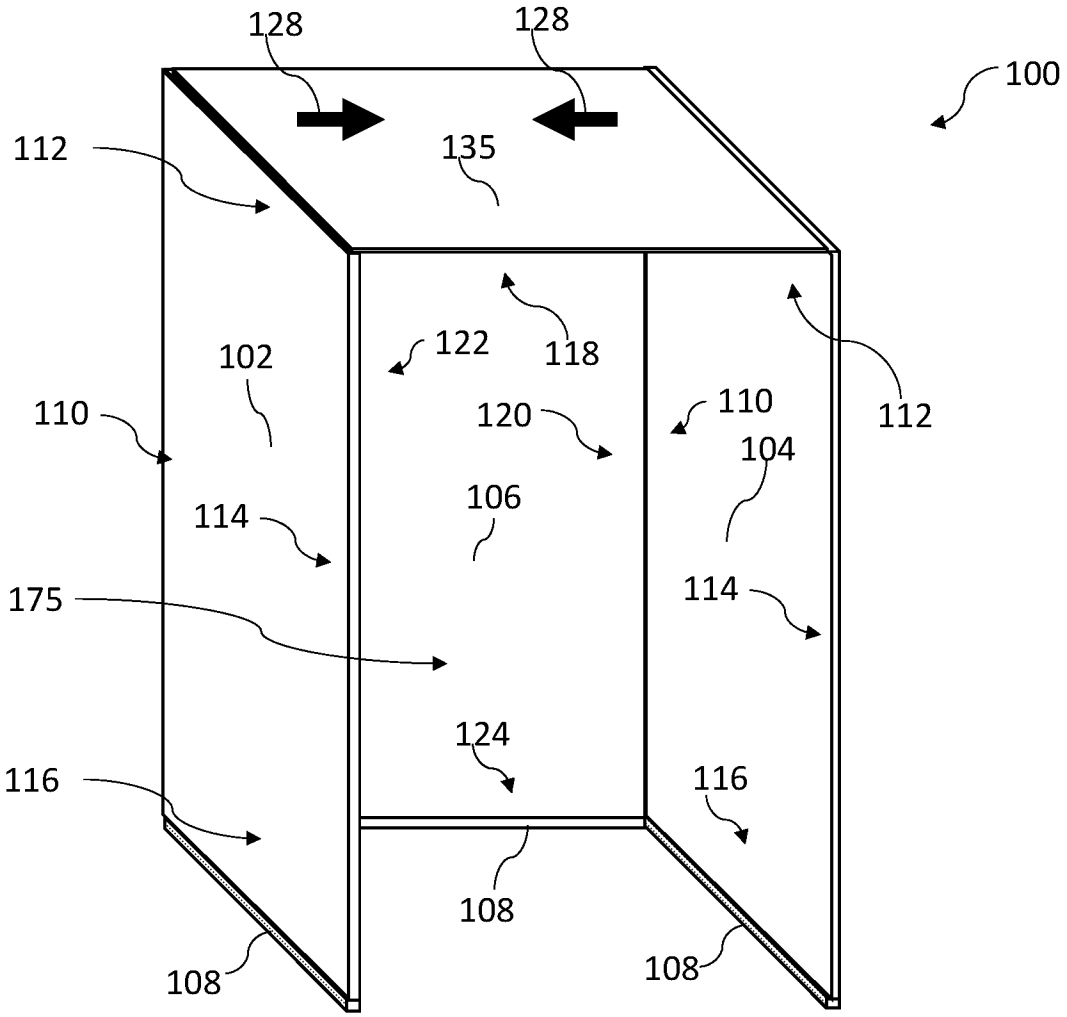

Referring now to FIG. 1C, booth 100 is seen to also include a ceiling member 135. Ceiling member 135 is attached to upper edge portions 112 and 118 of cubicle 100. Ceiling member 135 provides structural continuity as denoted by the pair of arrows 128.

Figure 1D:
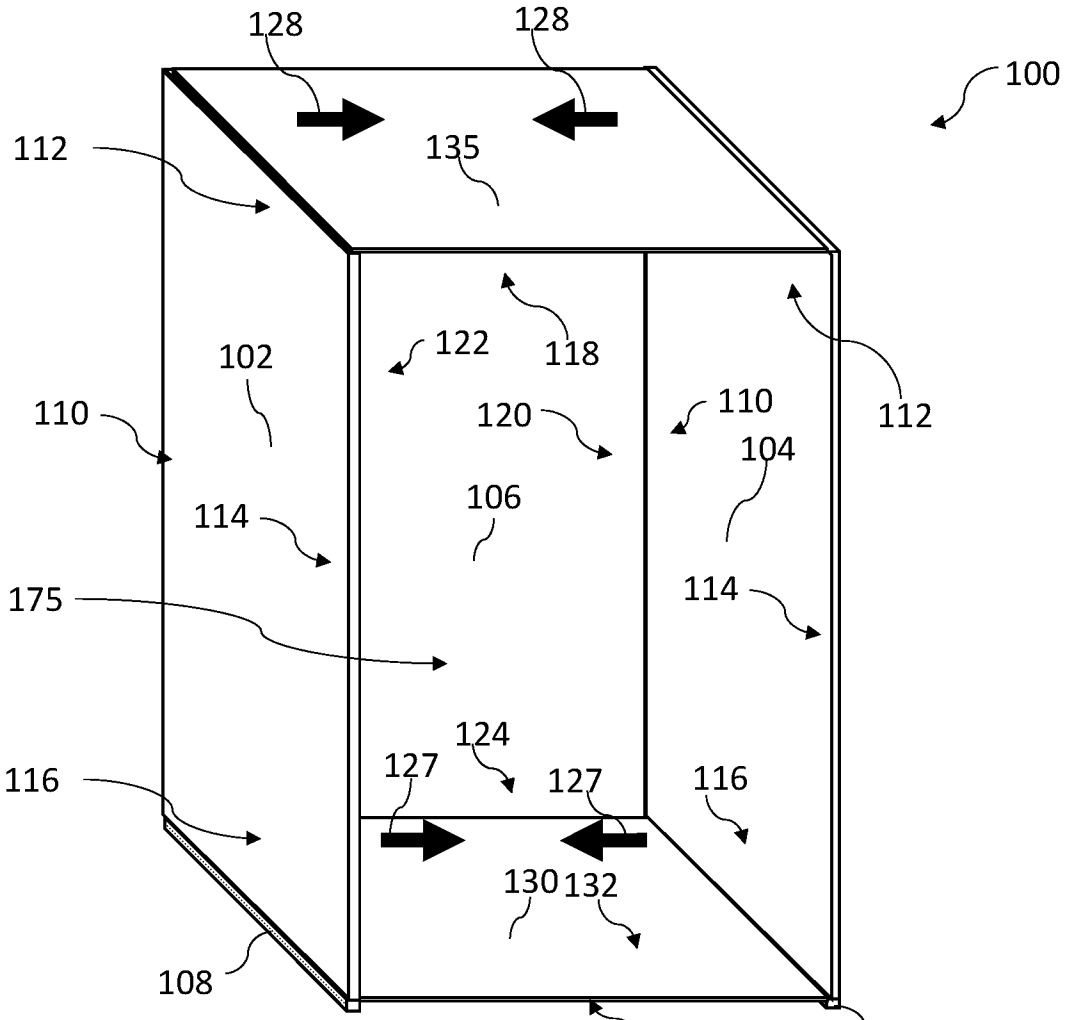

Referring briefly to FIG. 1D, booth 100 is seen to also include both floor element 130 and ceiling element 135.

Figure 1E:
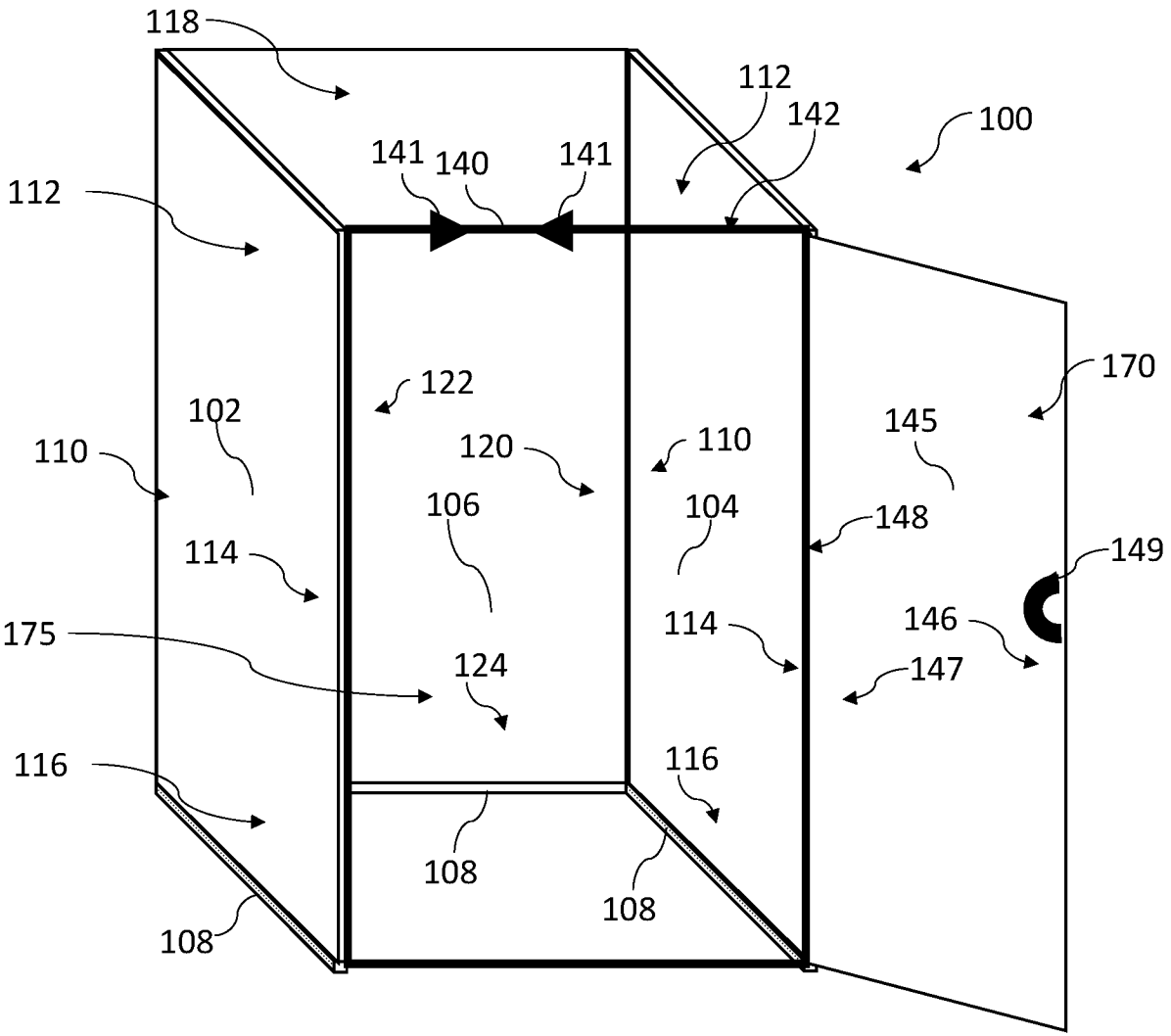
FIGS. 1E-1F are schematic illustrations of a low-slung movable personal booth seen in FIG. 1B, with the addition of a door.
Figure 1F:
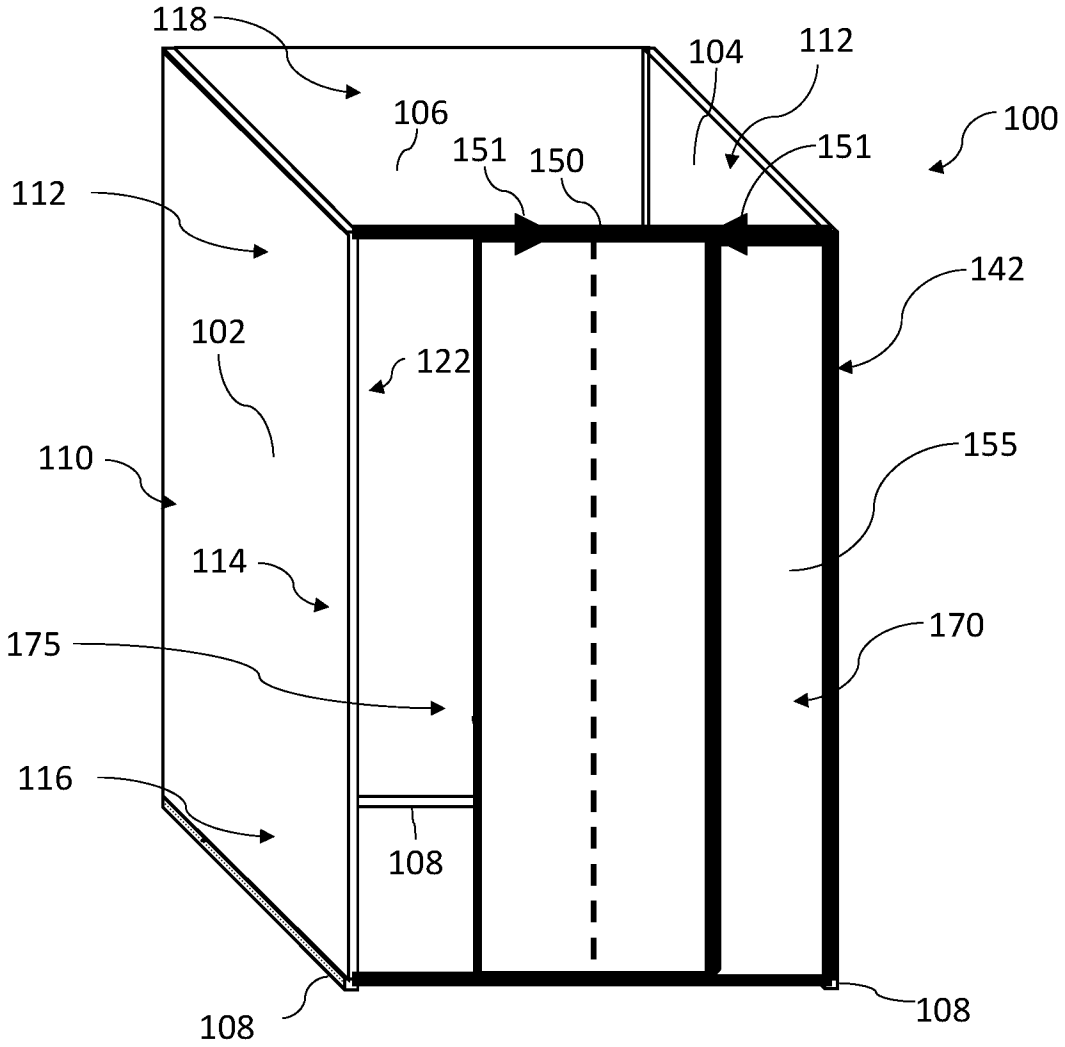

Referring now to FIGS. 1E-1F, booth 100 is seen to also include a closure member 170 and a mounting member 142, to isolate the usable space within the booth 100 from the exterior. In some embodiments, as schematically illustrated in FIG. 1E, closure member 170 is hinged door 145 and mounting element 142 is a hinged door frame 140. Hinged door 145 is connected by a hinge mechanism 148 to frame 140 Which is itself mounted onto respective front edge portions 114, thereby enabling hinged door 145 to close front-facing opening 175. In some embodiments, hinged door 145 has two parallel side portions 146 and 147. The hinge mechanism 148 can be attached to side edge portion 147, and a latching mechanism 149 is attached to side edge portion 146 to facilitate maintaining closure member 145 in a closed state. In some embodiments, the hinge mechanism 148 and latching mechanism 149 are attached in reverse, where the hinge mechanism is attached to side edge portion 146 and the latching mechanism is attached to side edge portion 147. Frame 140 provides structural continuity of booth 100 as denoted by arrows 141.

In some embodiments, as seen in FIG. 1F, closure member 170 is a sliding door 155, and mounting member 142 is a track member 150. Sliding door 155 is mounted onto track member 150. Track member 150 is mounted onto respective front facing edge portions 114 of sidewalls 102 and 104 and connects therebetween. Additionally, in some embodiments, track member 150 provides structural continuity as denoted by arrows 151. In some embodiments, the closure member 170 is a bifold door, an accordion door, or any other applicable partition to enclose the usable space within booth 100. In some embodiments, acoustic and visual distractions of a user within the interior of booth 100 are reduced when closure member 170 is in a closed position.

Figure 1G:
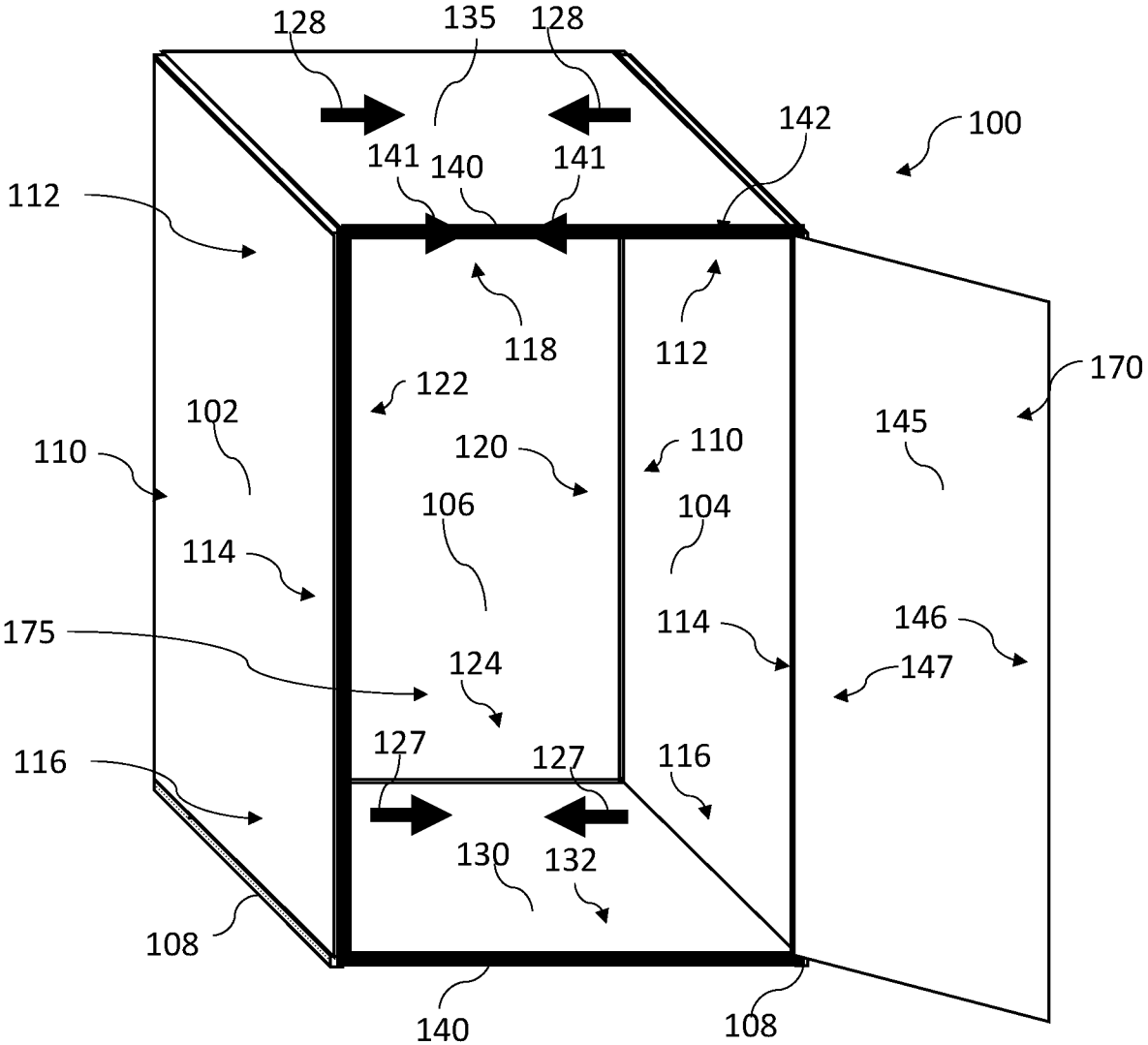
FIG. 1G is a schematic illustration of a low-slung movable personal booth seen in FIG. 1D, with a floor, ceiling, and door.

Referring to FIG. 1G, booth 100 is seen to include ceiling member 135, floor member 130, closure member 170, and mounting member 142, which act as structural continuity members for booth 100, as indicated by arrows as is illustrated by arrow pairs 128, 127 and 141. These members also combine to provide general structural stability for booth 100.

Figure 1H:
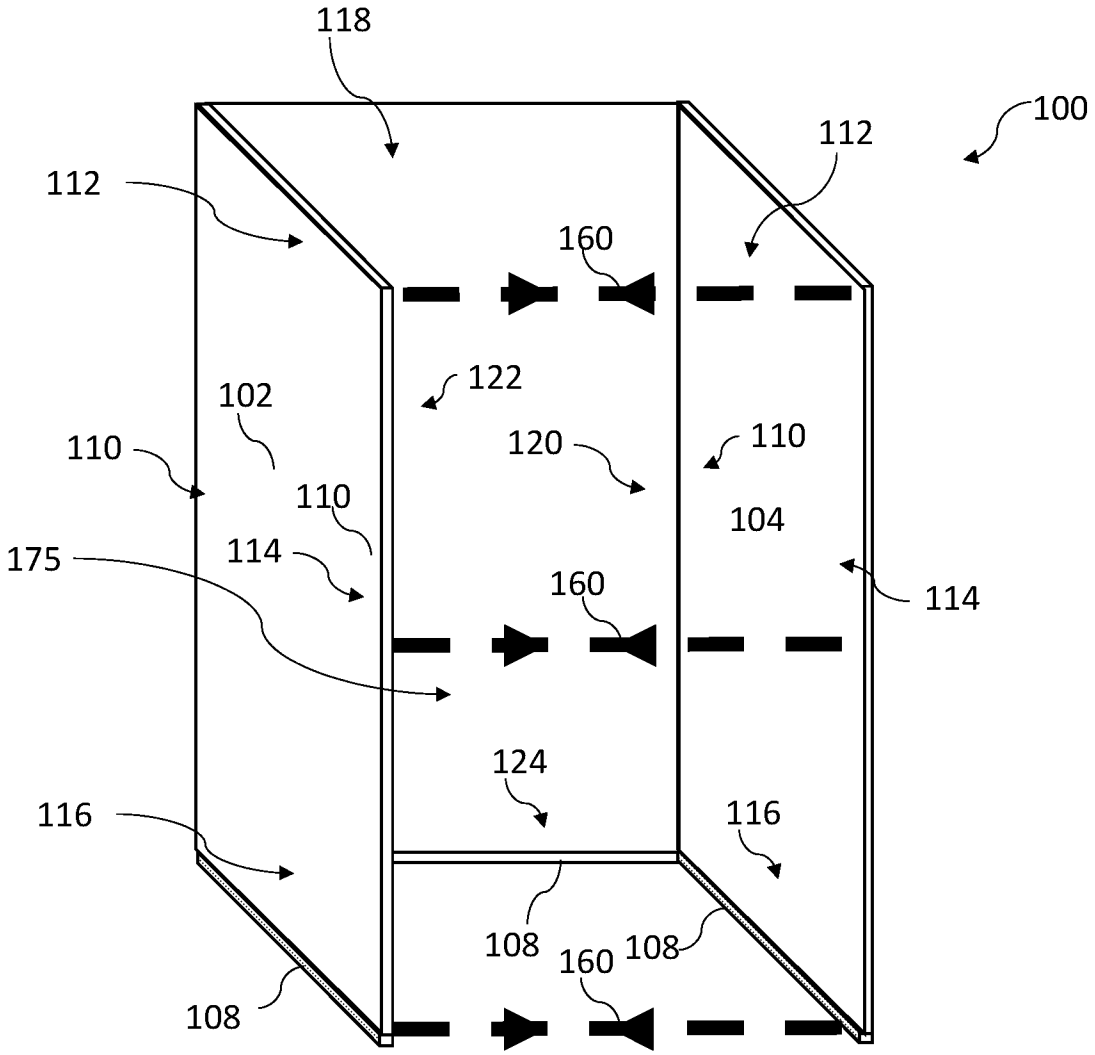
FIG. 1H is a schematic illustration of a low-slung movable personal booth as seen in FIG. 1A, with a removable structural tie member.

Referring to FIG. 1H, booth 100 may require additional structural support to further reinforce booth 100 during repositioning. In some embodiments, such additional structural support may be provided by a structural tie or brace member 160 which may be fastened to front facing edge portions 114. Once tie member 160 is attached, booth 100 can be moved to a desired location. Once the booth 100 is positioned in the desired location, tie member 160 can be detached from booth 100. In some embodiments, structural tie member 160 is a cross beam provided with suitable clasping members or mechanisms at each end, removably connectable to each of the opposing sidewalls 102 and 104.

Figure 2:
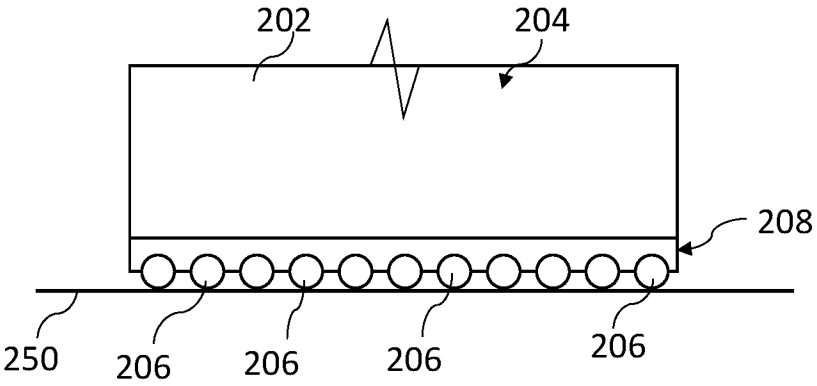
FIG. 2 is a schematic side-sectional illustration of a lower edge portion of the low-slung movable personal booth seen in any of FIGS. 1B, and 1D-1G.

Reference is now made to FIG. 2, which is a side-sectional illustration of a lower edge portion 204 of a sidewall 202 of the booth 100. Attached to the lower edge portion 204 is an elongate low friction mobility apparatus 208. Embedded into low friction mobility apparatus 208 are one or more low friction mobility elements 206. Low friction mobility elements 206 are arranged typically equidistantly from each other to uniformly distribute both static and dynamic loads. In some embodiments, low friction mobility elements 206 are spherical ball casters, mini ball transfer units, or any other suitable wheel element. In some embodiments, low friction mobility elements 206 may be constituted by an anti-static low friction synthetic material, as described hereinabove.

Figure 3A:
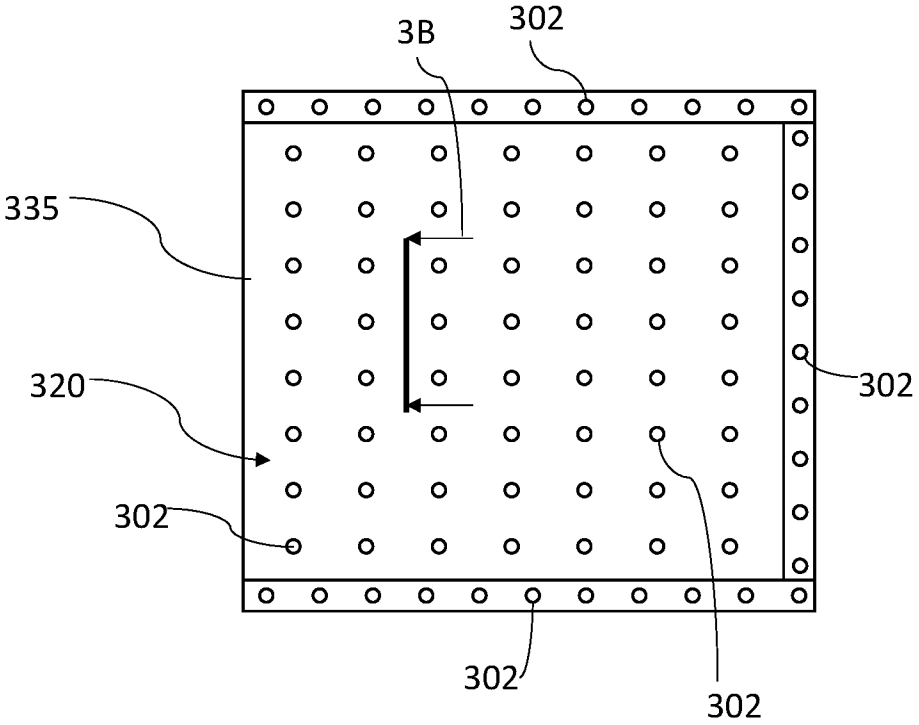
FIG. 3A is a schematic bottom view of the low-slung movable personal booth as seen in FIG. 2.

Referring now to FIG. 3A, which is a bottom view of the booth with a floor member 335. Low friction mobility elements, collectively referred to as 302, are arranged in an array formation, distributed across the downward-facing surface 320 of the floor member 335. The array of low friction mobility elements 302 provides structural support for floor member 335, directly supporting it on support surface 350.

Figure 3B:
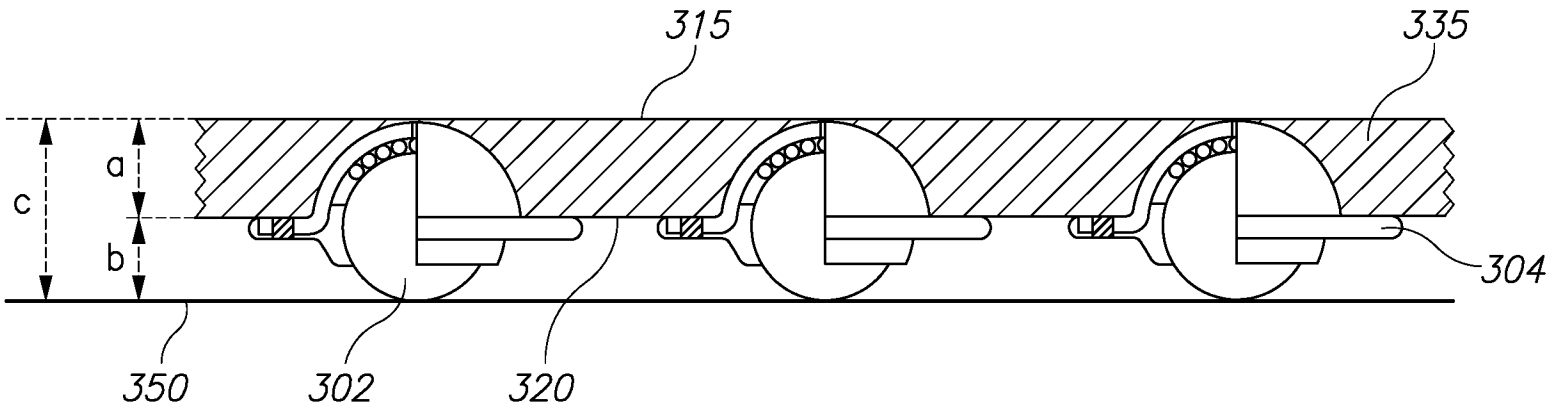
FIGS. 3B-3C are enlarged, detailed cross-sectional views of a portion of the floor element illustrated in FIG. 3A, according to a certain exemplary embodiments.

Referring now to FIG. 3B, in the illustrated example, low friction mobility elements 302 are seen to be embedded into floor element 335 so as to protrude from downward-facing surface 320 of the floor member 335. As illustrated, elements 302 are embedded into floor member 335 to a depth which is almost equal to the thickness a of floor member 335. This provides for a minimal clearance b of the downward-facing surface 320 above support surface 350, and a combined height c of the upward-facing surface 315 of the floor member 335 also to be at a minimal clearance, when taking into account the floor thickness a, such that a+b=c. In some embodiments, each low friction mobility element 302 is secured to the downward-facing surface 320 of the floor member 335 by a flange 304.

Figure 3C:
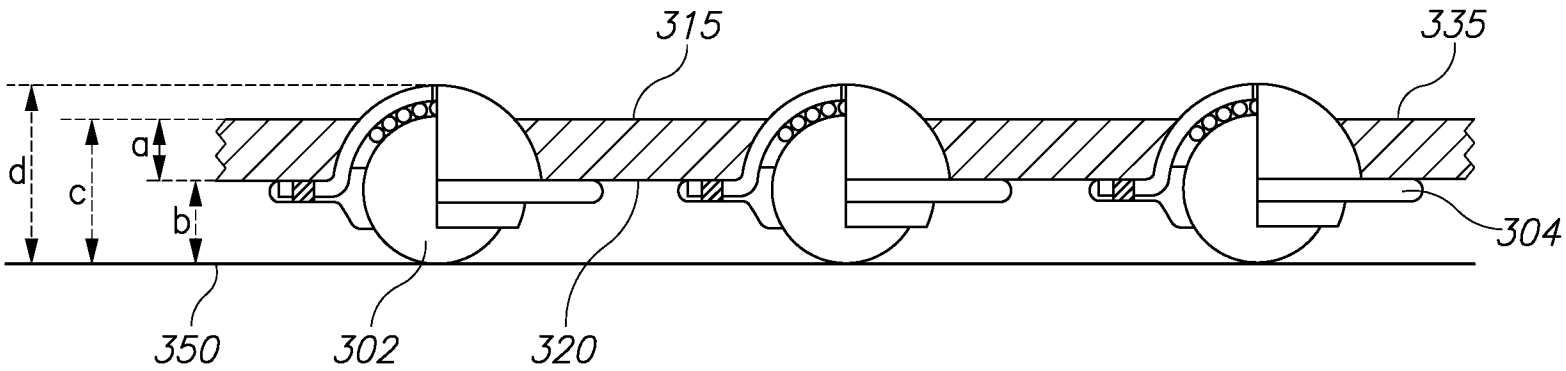

Referring briefly now to FIG. 3C, in the illustrated example, as in FIG. 3B, low friction mobility elements 302 are seen to be embedded into floor element 335. However, in contrast to the example of FIG. 3B, in the present example low friction mobility elements 302 are embedded within floor element 335 so as to protrude upwardly through upward facing surface 315 of floor element 335. This reduces even further the clearance of the upward-facing surface 315 of the floor member 335 above to support surface 350.

Figure 4A:
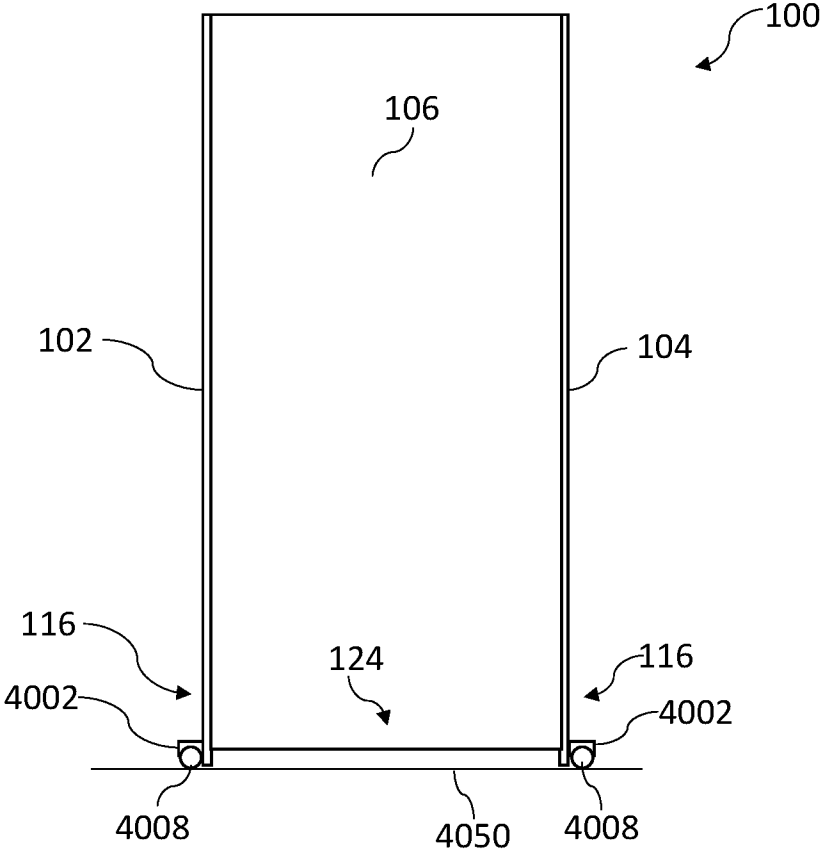
FIGS. 4A-4B are schematic illustrations of a low-slung movable personal booth in accordance with certain exemplary embodiments.
Figure 4B:
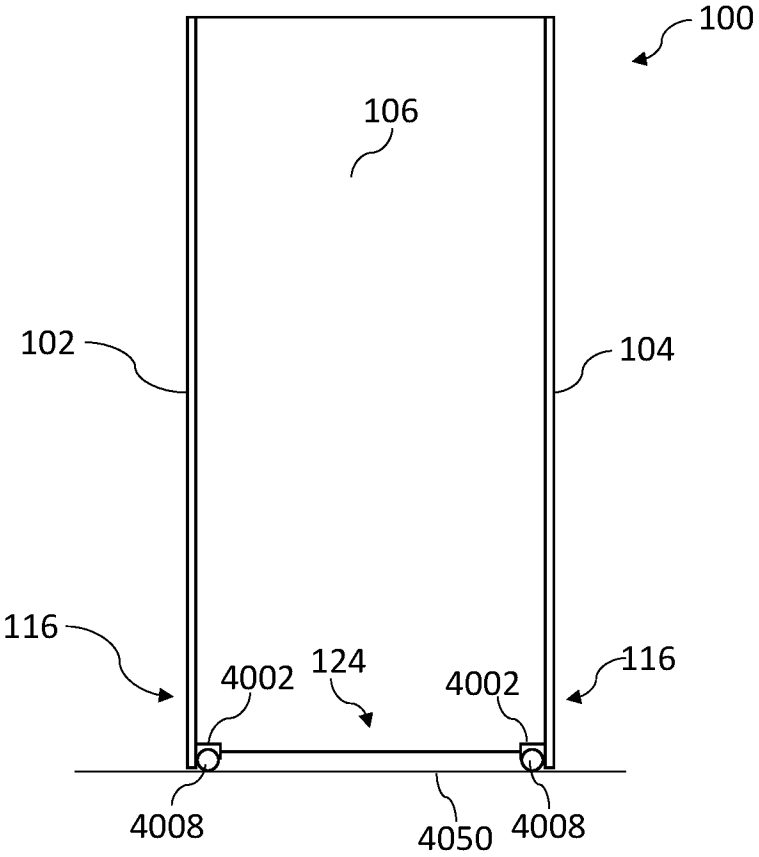

Referring now to FIGS. 4A-4B, in some embodiments, there are provided a pair of elongated track members 4002 for mounting a plurality of mobility elements 4008 along or in proximity to the lower edge portions 116 of the opposing side walls 102 and 104. In some embodiments, there is an additional elongated track element (not shown) attached along or in proximity to the lower edge portion 124 of the rear wall 106. The row of low friction mobility elements 4008 provides even load distribution of cubicle 100 throughout the elongate track element 4002 against the support surface 4050. In some embodiments, elongate track element 4002 is mounted onto the outside facing surface of the opposing side walls 102 and 104, as schematically illustrated in FIG. 4A. In some embodiments, the elongate track element 4002 is attached to the inside facing surface of the opposing side walls 102 and 104, as schematically illustrated in FIG. 4B.

Figure 5:
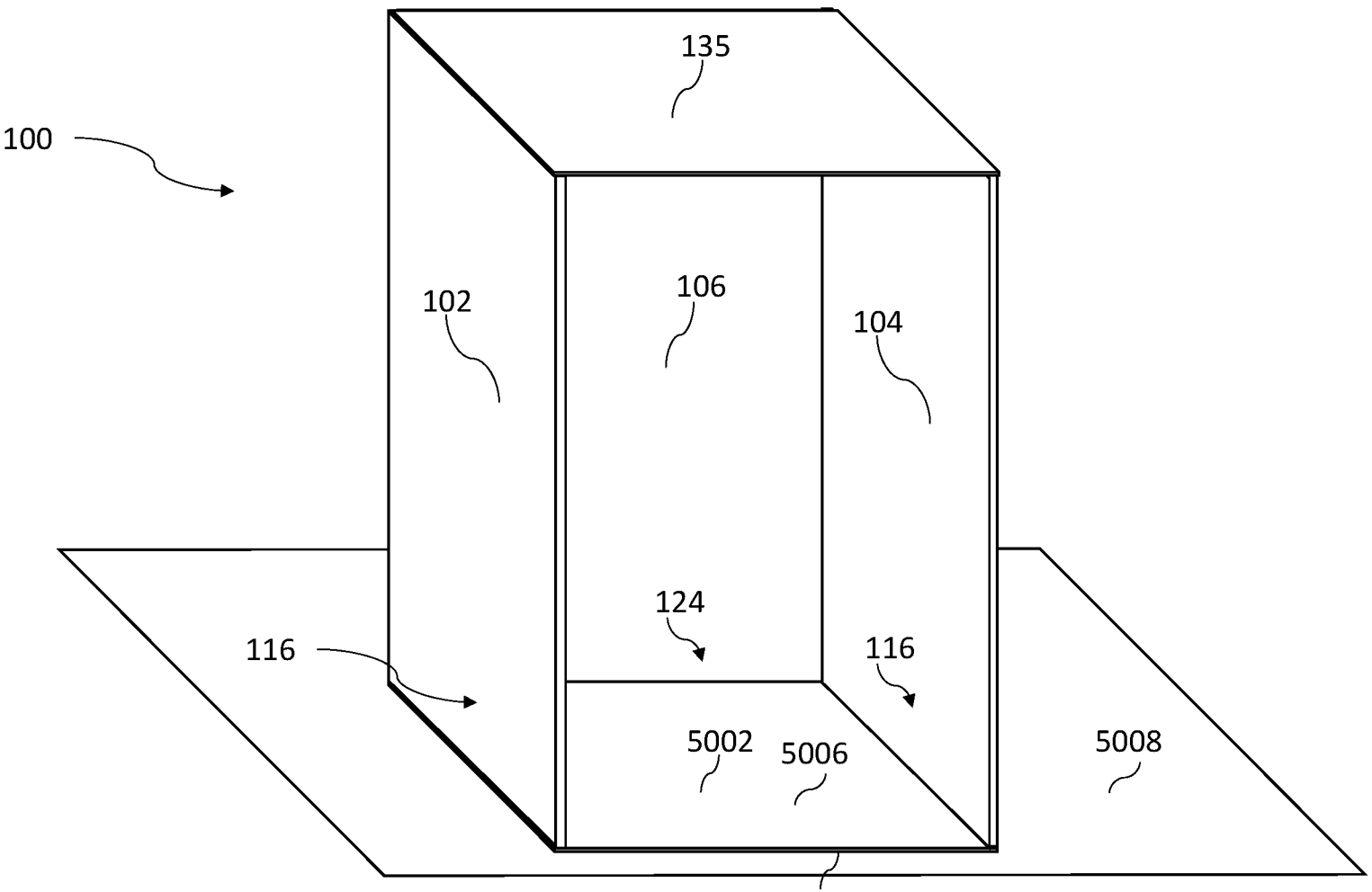
FIG. 5 is a schematic illustration of a low-slung personal booth where the downward facing surface of the floor is a low friction surface.

In some embodiments, as schematically illustrated in FIG. 5, booth 100 includes a floor member 5002, configured to support the cubicle structure of booth 100 on a support surface 5008. Floor member 5002 has an upper facing surface 5006 and a downward facing surface 5004. Respective opposing sidewalls 102 and 104, and the rear wall 106 are affixed to upward facing surface 5006. Downward facing surface 5004 is configured to be in full contact with a support surface 5008. Downward facing surface 5004 is made of a synthetic material with a low coefficient of friction that allows the booth to glide easily on support surface 5008. In some embodiments, the low coefficient of friction can be within a range of 0.01 to 0.5. The synthetic material can be a composed of a synthetic ice material, as can be found at www.glicerink.com/, or any other suitable material.

Figure 6A:
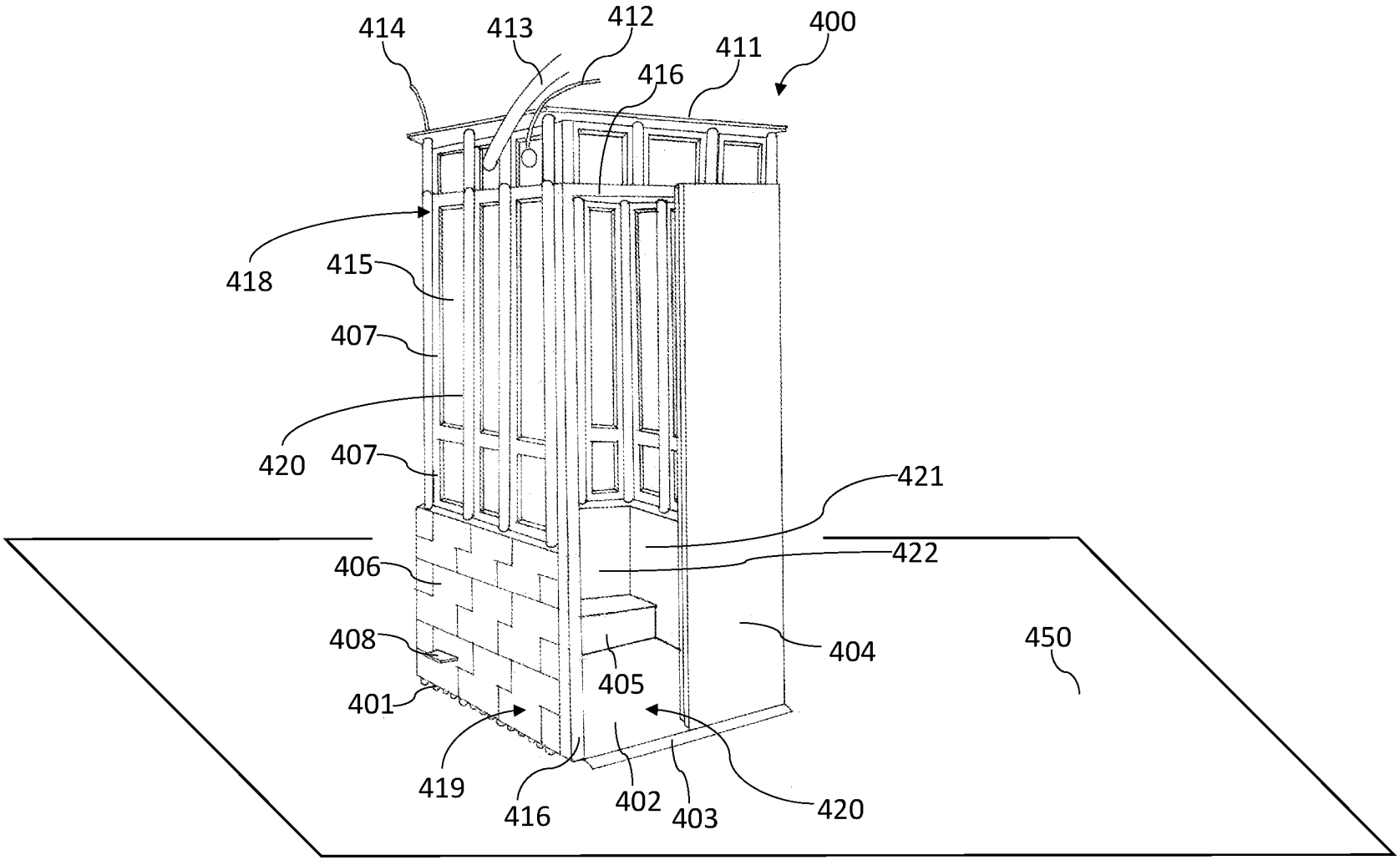
FIG. 6A is a schematic illustration of an embodiment similar to that seen in FIG. 1F, but also having a ceiling, and wherein at least a portion of a sidewall thereof is formed of connected, interleaving construction blocks.

In some embodiments, as schematically illustrated in FIG. 6A, movable personal booth 400 is seen to include construction blocks 406 and other construction elements 407. Construction elements 407 have a window 415 to allow ambient light to enter booth 400. In some embodiments, opposing sidewalls 420 and 421, and rear wall 422 are formed entirely of construction blocks 406 or elements 407. Construction blocks 406 that form the lower edge portion 419 of opposing sidewalls 420 and 421 are configured for embedding low friction mobility elements 401 therein to allow for movement of booth 400. Elongate locking members 445 are inserted into a shaped opening within the blocks 406 and elements blocks 407 in order to lock them in place. In some embodiments, locking members 445 are hollow to allow for conduction mediums to extend therethrough, such as electrical wire 414, water supply lines 412, or an air supply pipe 413 thereby entering neatly into the cubicle structure to provide electricity, water, or ventilation within booth 400.

Floor member 402 is connected to lower edge portion 419. A ramp member 403 is connected to floor member 402 at the front-facing opening 420 thereby bridging the gap that is formed between floor member 402 and a support surface 450, allowing users to safely enter booth 400. Closure member or door 404 is mounted onto mounting member 416. Ceiling element 411 is connected to upper wall portion 418 of booth 400.

In some embodiments, booth 400 includes a step-shaped feature 405, positioned along rear wall 422. Step 405 can be configured as a bench. In some embodiments, step 405 is hollow and houses a braking mechanism 503, which is further described in greater detail below, in conjunction with FIG. 7.

In some embodiments, there is provided a water supply line 412, which enters booth 400 through the ceiling element 411, to provide water for a fire sprinkler system within the booth 400. In some embodiments, there is provided an air conditioning or ventilation supply pipe 413 for climate control within the booth 400. In some embodiments water supply line 412 supplies water to a faucet (not shown) within booth 400.

Figure 6B:
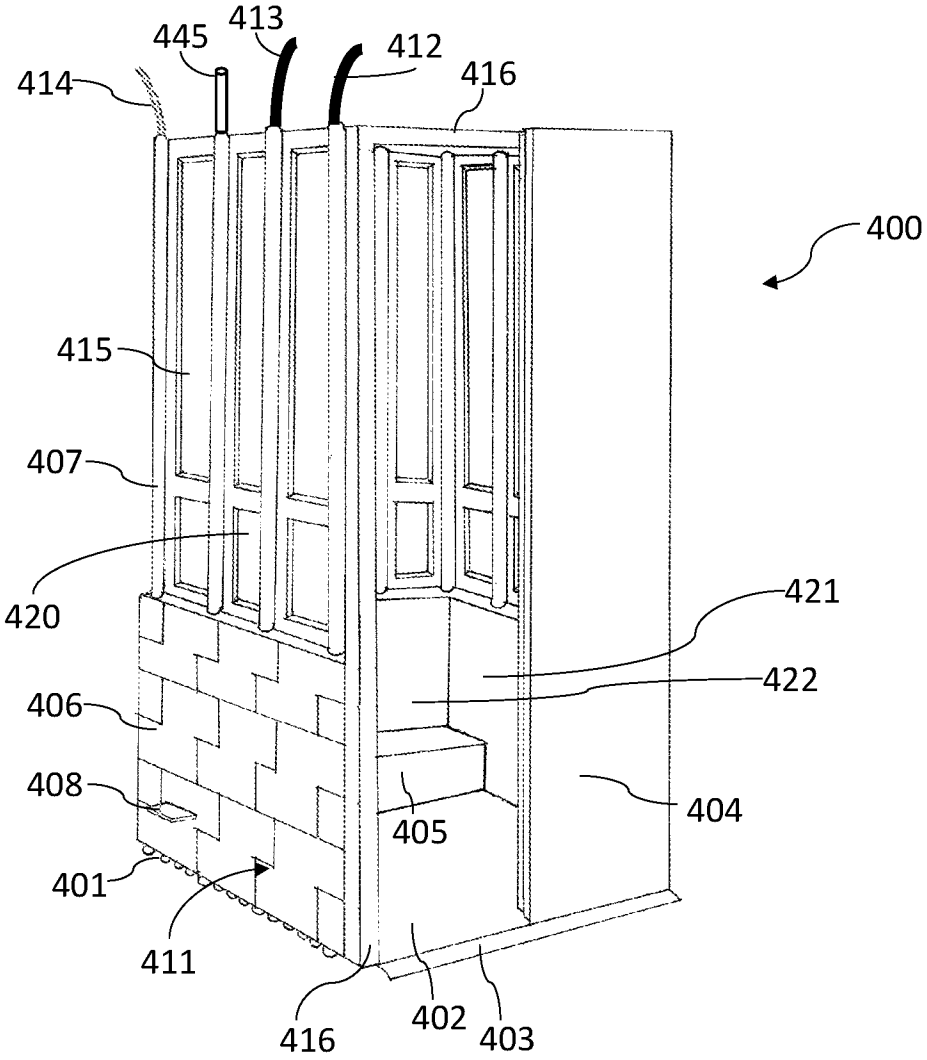
FIG. 6B depicts an embodiment similar to FIG. 4A but without a ceiling.

Referring to FIG. 6B, booth 400 is similar to that illustrated in FIG. 6A, but includes a floor element 402 only, excluding the ceiling element 411 (FIG. 6A). In contrast thereto, the booth 400 as illustrated in FIG. 6C, includes ceiling element 411 only, without floor element 402.

Figure 6C:
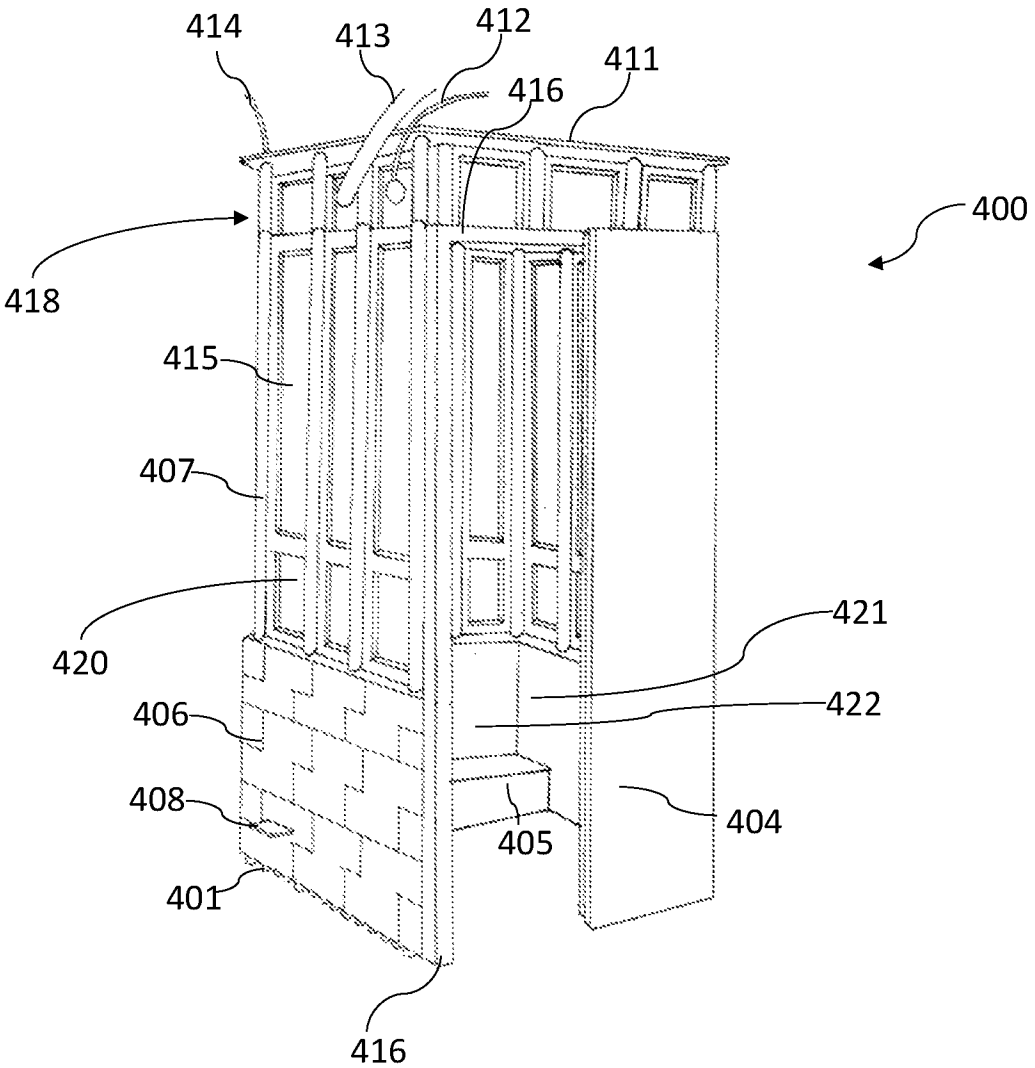
FIG. 6C depicts an embodiment similar to FIG. 4A but without a floor.
Figure 6D:
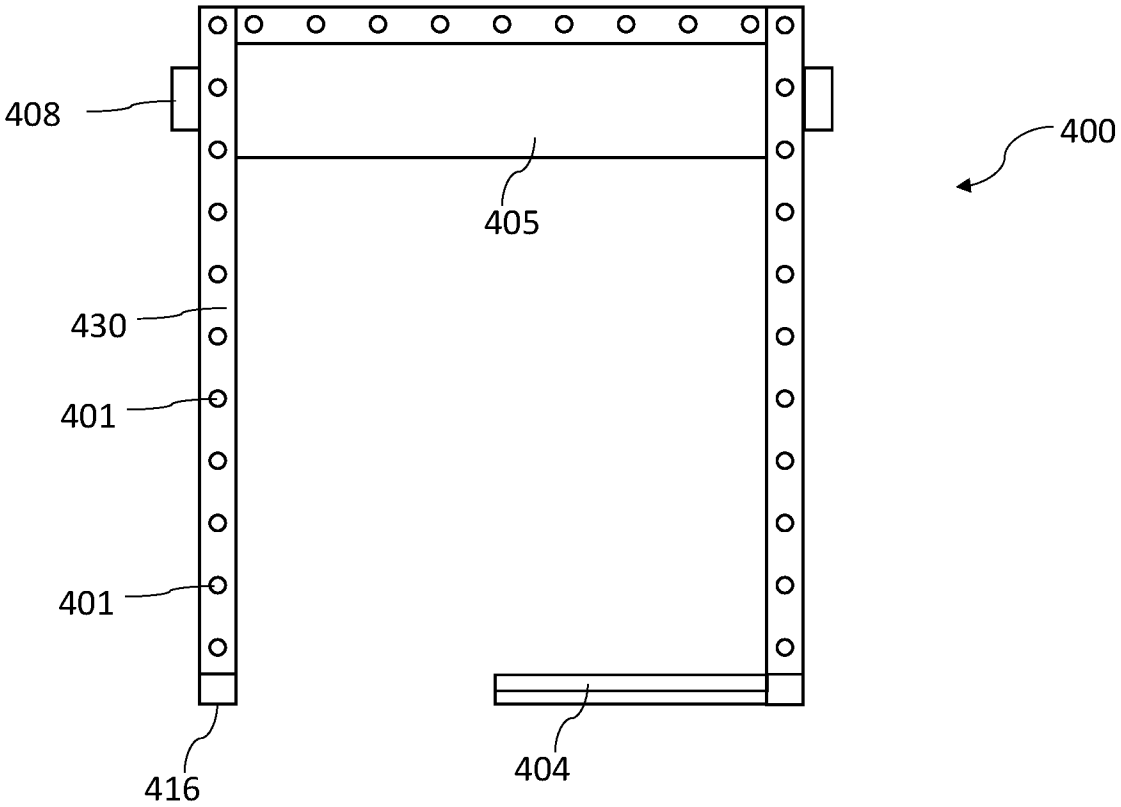
FIG. 6D is bottom view of the embodiment of FIG. 6C.

Referring to FIG. 6D, schematically illustrating a bottom view of booth 400 as seen in FIG. 6C. Low friction mobility elements 401 are aligned along the bottom edges 430 of sidewalls 420 and 421 and rear wall 422.

Figure 7:
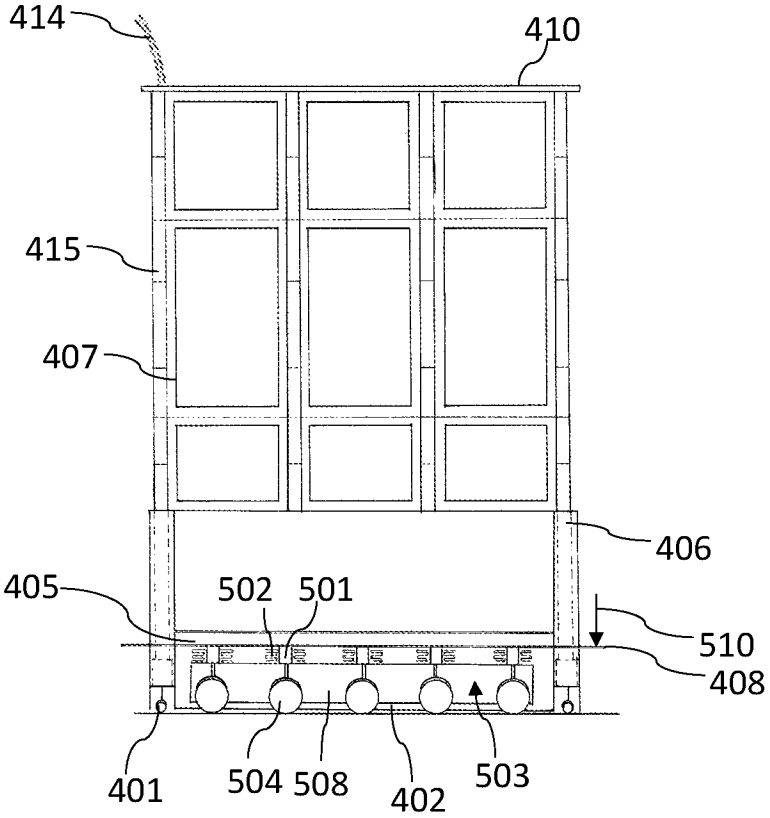
FIG. 7 is a schematic illustration of low-slung movable personal booth as illustrated in FIGS. 6A-6D from a rear perspective, with the view of a braking mechanism.

Referring now to FIG. 7, booth 400 includes braking wheel elements 504 housed within step 405 as mentioned above, booth 400 includes a braking mechanism, referenced generally as 503, operative to prevent unintentional movement of booth 400. Braking mechanism 503 includes a lever 408, a spring 502, a piston 501, and a braking pad 508. Braking pad 508 is configured to press against wheel elements 504 thereby preventing the movement of wheel elements 504 when a downward force is applied to lever 408, as indicated by arrow 510. Lever 408 applies an equivalent force onto piston 501, resulting in braking pad 508 being pushed against spherical wheel elements 504 thereby preventing the rotation of spherical wheel elements 504. When movement of booth 400 is desired, a release button can be actuated thereby releasing spring 502, which pushes lever 408 upwards and disengaging braking pad 508 from wheel elements 504. In some embodiments, the braking mechanism 503 can be released by applying an upward force to lever 408.

As used herein the term "configuring" and/or 'adapting' for an objective, or a variation thereof, implies using materials and/or components in a manner designed for and/or implemented and/or operable or operative to achieve the objective.

Unless otherwise specified, the terms 'about' and/or 'close' with respect to a magnitude or a numerical value implies within an inclusive range of −10% to +10% of the respective magnitude or value. Unless otherwise specified, the terms 'about' and/or 'close' with respect to a dimension or extent, such as length, implies within an inclusive range of −10% to +10% of the respective dimension or extent. Unless otherwise specified, the terms 'about' or 'close' imply at or in a region of, or close to a location or a part of an object relative to other parts or regions of the object.

When a range of values is recited, it is merely for convenience or brevity and includes all the possible sub-ranges as well as individual numerical values within and about the boundary of that range. Any numeric value, unless otherwise specified, includes also practical close values enabling an embodiment or a method, and integral values do not exclude fractional values. A sub-range values and practical close values should be considered as specifically disclosed values. As used herein, ellipsis ( . . . ) between two entities or values denotes an inclusive range of entities or values, respectively. For example, A . . . Z implies all the letters from A to Z, inclusively.

The terminology used herein should not be understood as limiting, unless otherwise specified, and is for the purpose of describing particular embodiments only and is not intended to be limiting of the disclosed subject matter. While certain embodiments of the disclosed subject matter have been illustrated and described, it will be clear that the disclosure is not limited to the embodiments described herein. Numerous modifications, changes, variations, substitutions and equivalents are not precluded.

Terms in the claims that follow should be interpreted, without limiting, as characterized or described in the specification.

It will be appreciated by persons skilled in the art that the present invention is not limited by what has been specifically shown and described in conjunction with the drawings, hereinabove. Rather, the invention is limited solely by the claims, which follow:

What is claimed is:

1. A low-slung movable personal booth for positioning on a support surface including:

(a) first and second opposing sidewalls, each having a rear edge portion, a front edge portion, an upper edge portion, and a lower edge portion which terminates in a lower sidewall edge;

(b) a rear wall having a pair of parallel side edge portions, a lower edge portion which terminates in a lower rear wall edge, and an upper edge portion which terminates in an upper rear wall edge, wherein said rear edge portion of each of said first and second opposing sidewalls is rigidly connected to one of said pair of parallel side edge portions of said rear wall, such that said sidewalls and rear wall form a cubicle structure having a usable space therein;

(c) at least one structural continuity member connecting between said pair of opposing sidewalls thereby providing structural continuity within said cubicle structure, said at least one structural continuity member comprising a planar support element connecting between said lower edge portions of said cubicle structure, positioned to provide support to said cubicle structure on the support surface; and (d) low friction mobility means, mounted along said lower edge portion of each of said first and second sidewalls and of said rear wall and embedded within said planar support element, arranged to support said cubicle structure on the support surface and to facilitate movement of said cubicle structure along the support surface in response to a lateral force, and operative to distribute both static and dynamic loads, respectively caused by self-weight of said cubicle structure and movement thereof along the support surface, in a generally uniform distribution along said sidewalls, said rear wall and said planar support element.

2. A low-slung movable personal booth according to claim 1, wherein said planar support element is a floor element which comprises an upward facing surface and a downward facing surface, and said low friction mobility means comprises a plurality of low friction mobility elements embedded into said downward facing surface of said floor element, wherein said low friction mobility elements protrude from said downward facing surface to support said floor element on the support surface.

3. A low-slung movable personal booth according to claim 1, wherein said at least one structural continuity element comprises a ceiling element connected between said upper edge portions of said cubicle structure.

4. A low-slung movable personal booth according to claim 1, wherein said cubicle structure comprises a front facing opening, a closure element for providing access to the interior, and a mounting element for mounting said closure element in association with said front facing opening.

5. A low-slung movable personal booth according to claim 1, wherein said low friction mobility means is a plurality of ball transfer units aligned linearly and mounted in association with said lower edge portion of said first and second sidewalls and said rear wall, configured to evenly distribute both static and dynamic loads.

6. A low-slung movable personal booth according to claim 1, wherein said at least one structural continuity member comprises a tie member removably fastenable to said front edge portions of said first and second opposing sidewalls, for fastening thereto prior to movement of said low-slung movable personal booth and removal therefrom after movement.

7. A low-slung movable personal booth according to claim 1, wherein said low friction mobility means is a planar element formed of a low friction material.

8. A low-slung movable personal booth for positioning on a support surface including:

first and second opposing sidewalls, each having a rear edge portion, a front edge portion, an upper edge portion, and a lower edge portion which terminates in a lower sidewall edge;

a rear wall having a pair of parallel side edge portions, a lower edge portion which terminates in a lower rear wall edge, and an upper edge portion which terminates in an upper rear wall edge, wherein said rear edge portion of each of said first and second opposing sidewalls is rigidly connected to one of said pair of parallel side portions, such that said sidewalls and rear wall form a cubicle structure having a usable space therein;

a floor element which comprises an upward facing surface and a downward facing surface connecting between said pair of opposing sidewalls in association with said lower edge portions of said cubicle structure thereby providing structural continuity within said cubicle structure said sidewalls and said rear wall; and an array of low friction mobility elements embedded into said downward facing surface of said floor element, arranged to support said cubicle structure on the support surface and to facilitate movement thereof along the support surface in response to a lateral force, operative to distribute both static and dynamic loads, respectively caused by self-weight of said cubicle structure and movement thereof along the support surface, in a generally uniform distribution along said sidewalls, said rear wall and said floor element.

9. A low-slung movable personal booth according to claim 8, wherein said low friction mobility elements protrude through said upward facing surface of said floor element.

* * * * *